United States Patent [19]

Adelizi

[11] Patent Number: 4,625,901

[45] Date of Patent: Dec. 2, 1986

[54] MULTI-BLADE TAPE DISPENSER

[76] Inventor: Nicholas J. Adelizi, 12402 Patricia Dr., Cerritos, Calif. 90701

[21] Appl. No.: 784,039

[22] Filed: Oct. 4, 1985

[51] Int. Cl.[4] ..... B65D 85/672

[52] U.S. Cl. ..... 225/1; 225/37; 225/77; 225/88

[58] Field of Search ..... 225/38, 37, 34, 47, 225/46, 88, 80, 1, 77

[56] References Cited

U.S. PATENT DOCUMENTS

| | | | |
|---|---|---|---|
| 398,762 | 2/1889 | Winheim | 225/38 X |
| 1,447,594 | 3/1923 | Mackrodt . | |
| 2,708,076 | 5/1955 | Pulster et al. . | |
| 2,962,199 | 11/1960 | Kier . | |
| 3,547,327 | 12/1970 | Mariani . | |
| 3,635,383 | 1/1972 | Waltz | 225/37 |
| 4,262,835 | 4/1981 | Wrobel . | |

*Primary Examiner*—Frank T. Yost

*Attorney, Agent, or Firm*—Howard A. Kenyon

[57] ABSTRACT

A tape dispenser to allow multiple rolls of tape, some which are different widths, to be dispensed from a single dispenser without becoming entangled and sticking to the adjacent tape is disclosed. The dispenser contains two sets of blades spaced apart and attached to the dispenser housing. A guide bar is used adjacent to the lower blade to ensure the tape will approach the blade at an angle that will provide a clean cut. The tapes are placed on a tape core which is slid in an internal groove in the sides of the tape housing. The tapes are then fed to the cutting blades in an alternate manner which minimizes the risk of entanglement when being used.

23 Claims, 4 Drawing Figures

MULTI-BLADE TAPE DISPENSER

BACKGROUND OF THE INVENTION

1. Field of the Invention

This invention is directed to a tape dispenser in general and more specifically to a tape dispenser having multiple blades used in conjunction with a common core containing multiple tapes.

2. Description of the Prior Art

Tape dispensers have been in use for a considerable length of time and are a basic tool of the drafting and art industry. Some tape dispensers are designed to dispense tape with adhesive on one side of the tape while others have adhesive on both sides of the tape. In addition, tape dispensers are available that will hold an array of multicolored tapes that are used with various items such as wire identification and tubing identification. These identifying tapes are used extensively in the electronics and aircraft industry. The following prior art describes some of the known tape dispensing devices.

U.S. Pat. No. 3,547,327 to Mariani describes a dispenser for multiple material webs. Each spool or core may be individually removed and replaced from the housing without disturbing others cores. This is structurally different from the present invention.

U.S. Pat. No. 4,262,835 to Wrobel describes a multiple tape dispenser for wire marking tape that has a unique door and cut off blade which allows small segments of tape to be easily handled. Again, there are significant structure differences between this patent and the present invention.

U.S. Pat. No. 1,447,594 to Mackrodt describes a cabinet for wrapping paper that can utilize multiple rolls of paper of different widths. This invention describes a complex gate containing a blade and a spring to keep the paper from falling back inside the cabinet after being cut. The present tape dispenser having tape that is adhesive on one side needs no such devices.

U.S. Pat. No. 2,708,076 to Polster et al describes a multi-roll liner-wound tape dispenser that dispenses both one sided pressure sensitive tape and double sided pressure sensitive tape. The configuration is such that the liner of the double sided pressure sensitive tape is wound around a spare roller as the double sided tape is being used. This configuration is considerably structurally different from the present invention.

U.S. Pat. No. 2,962,199 to Kier describes a ribbon dispensing system that holds tension on the ribbon after cutting. The present invention does not have a tensioning device. Kier also has the ability to curl the ribbon. These devices of Kier are substantially different from the present invention.

SUMMARY OF THE INVENTION

It is therefore an object of the present invention to provide a multiple blade tape dispenser with an upper and lower cutting blade.

It is another object of the present invention to provide a dispenser with an upper and lower cutting blade that can provide tangle free multiple tape dispensing.

It is yet another object of the present invention to provide a multiple tape dispenser with an upper and lower cutting blade to dispense tapes of different width, spaced apart such that the adhesive side will not stick to the adjacent tape.

Briefly, in accordance with this invention, there is provided a tape dispenser that dispenses multiple rolls of tape utilizing an upper and lower cutting blade. A guide bar is provided to be utilized with the lower blade to guide the non-adhesive portion of the tape to ensure tha tape being cut by the lower blade is substantially perpendicular to the cutting blade edge. This will allow a smooth and uniform cut to be made on the tape by the lower blade. The dispenser is designed with a circular core which accepts tapes of varying widths. The tapes are fed to the upper and lower cutting blades in an alternating manner to preclude the adhesive portion of the tape from sticking to the adjacent tape.

Other objects and advantages of the invention will become apparent upon reading the following detailed description and upon reference to the drawings.

BRIEF DESCRIPTION OF THE DRAWINGS

1.

2.

3.

4.

The novel features which are believed to be characteristic of the invention as to the system together with further objects and advantages thereof, will be better understood from the following description in connection with the accompanying drawings in which the presently preferred embodiments of the invention is illustrated by way of example. It is to be expressly understood, however, that the drawings are for purposes of illustration and description only, and are not intended as a definition of the limits of the invention.

DETAILED DESCRIPTION OF THE INVENTION

Figure 1:
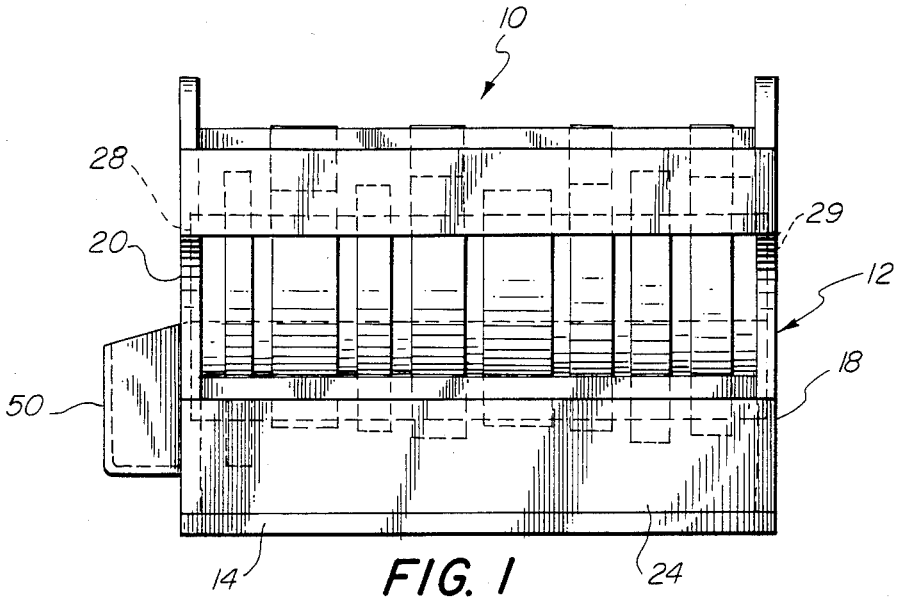
FIG. 1 is a front view of the multiple blade tape dispenser.

Turning now to FIG. 1 there is seen a front view of multi-blade tape dispenser 10 with housing 12. Also shown is a base 14 (FIG. 2) housing a hollow portion 16 and two sides 18 and 20. A first support member 22 is attached to the upper front portion of the sides 18 and 20, the support member 22 also being perpendicular to both sides 18 and 20. It is seen that in the preferred embodiment the first support member 22 extends from the outer edge of side 18 to the outer edge of side 20.

A second support member 24 also attached to sides 18 and 20, is also perpendicular to sides 18 and 20 and extends from the outer edge of side 18 to the outer edge of side 20.

Figure 2:
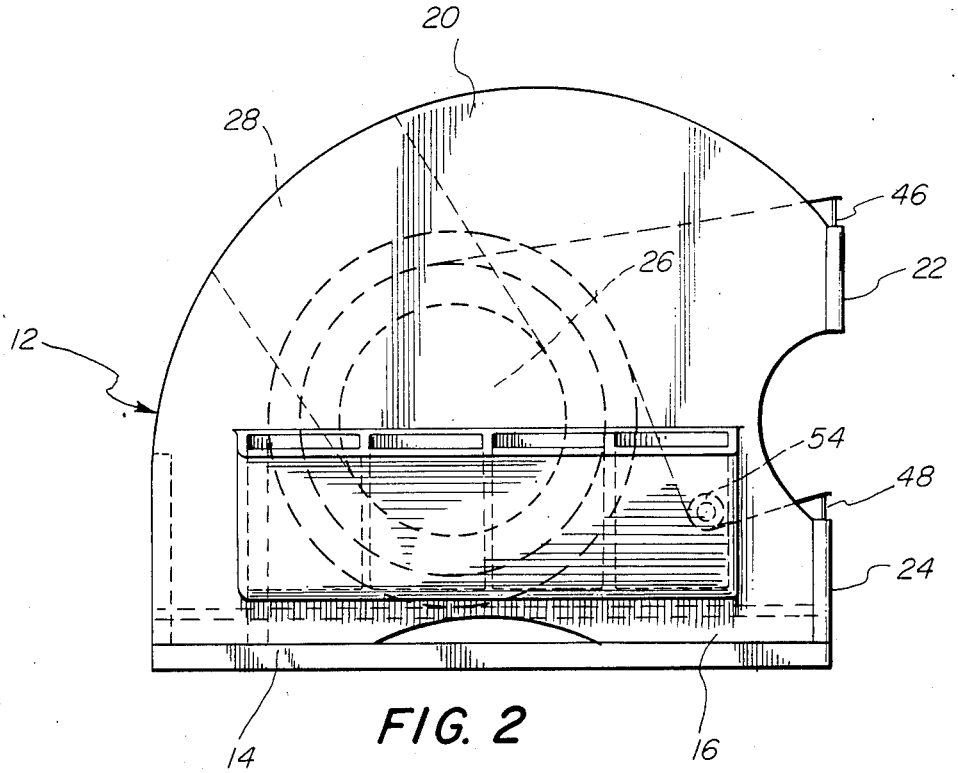
FIG. 2 is a side view of the multiple blade tape dispenser.

A circular tape core 26 is supported within housing 12. In the preferred embodiment the tape core is not secured within housing 12 but is allowed to slide in and out of housing 12 in groove 28. Although core 26 can rotate if so desired, the tapes 30 through 44 are loosely fitted on core 26 such that the tapes will turn on core 26 before the core 26 will rotate in groove 28 (FIG. 2). It should be noted that there is a corresponding groove 29 (FIG. 3) to receive core 26 in side 18.

Removable tape cut off blades 46 and 48 are set in grooves (not shown) in the top of first support member 22 and second support member 24 respectively. The grooves are fabricated such that the width is slightly less than the thickness of the rear of the cutting blades 46 and 48. In that manner, the blades 46 and 48 are removable for replacement or resharpending as required. Cutting blades 46 and 48 can be made with a serrated cutting edge if it is so desired. FIG. 1 also shows a drafting instrument holder 50 that is cantilevered and attached to the side 20 of housing 12.

Turning now to FIG. 2 there is seen a side view of multiple blade dispenser 10 showing the side 20 of housing 12. Groove 28 is cut into the inside of side 20 to allow core 26 to slide in and out as required. In order to replace any one of the tapes 30 through 44, core 26 must be slid out of groove 28, the specific tape replaced and thereafter core 26 is slid in groove 28 until it stops approximately midway in the housing 12 whereby groove 28 is terminated. Again, it is reiterated that groove 28 has a corresponding groove 29 (FIG. 3) fabricated on the internal face of the side 18 of housing 12. FIG. 2 also clearly shows the base 14 with the hollow portion 16 above base 14 which can be filled with dense material such as sand, lead, iron filings or the like, during manufacture to provide a heavy housing - base combination that will not slide when tape is pulled from the dispenser. An extra measure to prevent sliding would be gluing small rubber pads (not shown) on the corners of base 14.

A guide bar 54 is fixed between the sides 18 and 20 of housing 12. This bar preferably made from metal, fits into a hole slightly larger than the size of the bar 54. The hole is drilled only half way in the internal face of sides 18 and 20 of housing 12. The bar 54 is capable of rotating, however, the friction of the combined tapes 30 through 44 will prevent the bar 54 from rotating. The non-adhesive side of tapes 30 through 44 will slide on the guide bar 54. The purpose of the guide bar 54 is to provide the alternating tapes an approach angle of substantially 90 to the cut-off blade 48.

Figure 3:
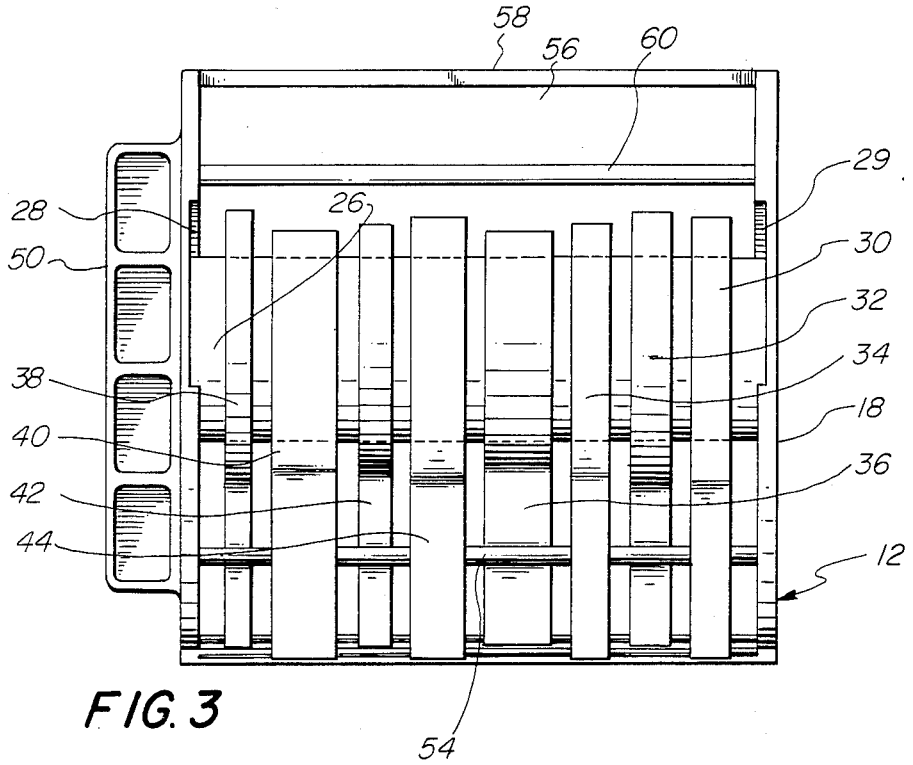
FIG. 3 is a top view of the multiple blade tape dispenser showing the drawing instrument holder attached to one side and the drawing instrument and tape holder attached to the rear of the housing.

FIG. 3 is a top view of the multi-blade tape dispenser 10. In this view it is clear to see that the tapes 30 through 44 are fed alternately to cut-off blades 46 and 48. In addition, it is seen in FIG. 3 how alternating tapes are fed under rod 54. FIG. 3 also shows the combination drafting instrument and tape holder 56 that is formed in the back of housing 12. The back of the combination drafting instrument and tape holder 58 form a back support member of housing 12 and the inner member 60 of the combintion drafting instrument and tape holder is evenly spaced apart from member 58. Both members 58 and 60 fit inside and are fastened to sides 18 and 20. Also shown in FIG. 3 is the instrument holder 50 which allows pencils, pens or the like to be placed.

Figure 4:
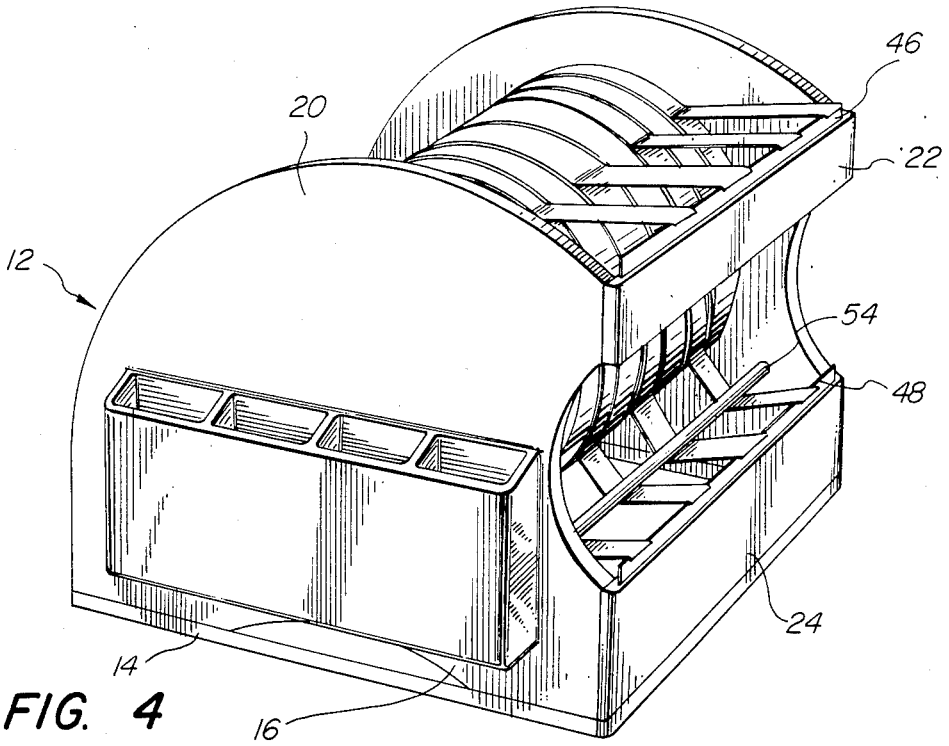
FIG. 4 is a perspective view of the multiple blade tape dispenser showing the alternating tape placement on the upper and lower blade holders.

FIG. 4 is a perspective view of the multi-blade tape dispenser 12.

The operation of the tape dispenser is simple and convenient. Core 26 is removed from housing 12 and loaded with a plurality of tapes. The number of tapes used depends on the desired length of the core member and the corresponding housing width and the width of the tape. The core 26 is thereby slid in groove 28 and allowed to come to rest. Tapes are then fed alternately to the upper and lower cut-off blades 46 and 48 with the lower tapes being fed around the guide bar 54. The tapes are then placed on the respective cut-off bar whereby they are ready to be conveniently used without becomming entangled with each other.

Accordingly, there has been provided, in accordance with the invention, a multi-blade tape dispenser that fully satisfies the objectives set forth above. It is understood that all terms used herein are descriptive rather than limiting. While the invention has been described in conjunction with specific embodiments, it is evident that many alternatives, modifications, and variations will be apparent to those skilled in the art in light of the disclosure herein. Accordingly, it is intended to include all such alternatives, modifications, and variations that fall within the spirit and scope of the appended claims.

What is claimed is:

1. A tape dispenser having at least two cut off blades comprising:

a housing, having a hollow base with two sides perpendicular to said base, said sides securely fastened to the edge of said base;

a first support member securely fastened to the upper front portion of said sides of said housing, said support member being perpendicular to each of said sides of said housing and extending from the outside edge of one side to the outside edge of the other side;

a second support member securely fastened to the lower front portion of said sides of said housing, said second support member being perpendicular to each of said sides of said housing and extending from the outside edge of one side to the outside edge of the other side;

a circular tape core supported within said housing;

a removable tape cut-off blade secured to and extending across the top edge of said first support member;

a removable tape cut-off blade secured to and extending across the top edge of said second support member;

a guiding member supported within said housing, said guiding member extending into but not through the sides of said housing;

a drafting instrument holder attached to one of said sides of said housing;

a combination drafting instrument and tape holder supported within said housing back portion and further located where the bottom of said combination instrument and tape holder is even with the bottom of each of said sides and said base.

2. A tape dispenser as described in claim 1 wherein said first support member is spaced apart from said second support member.

3. A tape dispenser as described in claim 1 wherein said tape core contains a plurality of pressure sensitive tape rolls loosely mounted on said core.

4. A tape dispenser as described in claim 1 wherein said guiding member is a rotating round bar.

5. A tape dispenser as described in claim 1 wherein said tape core diameter is slightly less then the internal diameter of the tape roll.

6. A tape dispenser as described in claim 1 wherein said core is supported by a groove cut in the internal portion of said sides, said groove terminating approximately midway on each of said sides.

7. A tape dispenser as described in claim 6 wherein said core is inserted in and removed from said housing by sliding the ends of said core along said groove.

8. A tape dispenser as described in claim 1 wherein said groove to receive said core starts at the upper-back portion of said sides and extends forward and downward on the internal portion of said sides.

9. A tape dispenser as described in claim 8 wherein said tape rolls are placed on said core.

10. A tape dispenser as described in claim 1 wherein said tape rolls are alternately fed to said top blade and said bottom blade respectively.

11. A tape dispenser as described in claim 10 wherein said tape rolls fed to said bottom blade are threaded around said guiding member with the non-adhesive side bearing on said guiding member, and said tape is substantially perpendicular to said bottom blade.

12. A tape dispenser as described in claim 1 wherein said tape blades are held in a vertical position by holding means with the cutting edge on top.

13. A tape dispenser as described in claim 1 wherein said tape blades are serrated on the top edge.

14. A tape dispenser as described in claim 1 wherein said tape blades are fabricated from a suitable steel.

15. A tape dispenser as described in claim 1 whrein said housing is fabricated from a suitable plastic.

16. A tape dispenser as described in claim 1 wherein said hollow base is filled with a high density material.

17. A tape dispenser having at least two cut off blades comrprising:

a plastic housing, having a hollow base with two sides perpendicular to said base, said sides securely fastened to the edge of said base, said hollow base filled with a high density material;

a first support member securely fastened to the upper front portion of said sides of said housing, said support member being perpendicular to each of said sides of said housing and extending from the outside edge of one side to the outside edge of the other side, said first support member spaced apart from said second support member;

a second support member securely fastened to the lower front portion of said sides of said housing, said second support member being perpendicular to each of said sides of said housing and extending from the outside edge of one side to the outside edge of the other side;

a tape core supported within said housing, wherein said tape core contains a plurality of pressure sensitive tape rolls loosely mounted on said core, said tape core is cylindrical in shape and is supported by a groove cut in the internal portion of said sides, said groove terminating approximately midway on each of said sides;

a removable steel cut off blade secured to and extending across the top edge of said first support member, wherein said tape blade is held in a vertical position by holding means with the cutting edge on top;

a removable steel cut off blade secured to and extending across the top edge of said second support member, wherein said tape blade is held in a vertical position by holding means with the cutting edge on top;

a guiding member supported within said housing, said guiding member extending into but not through the sides of said housing, wherein said guiding member is a rotating round bar;

a drafting instrument holder attached to one side of said housing;

a combination drafting instrument and tape holder supported within said housing back portion and further located where the bottom of said combination instrument and tape holder is even with the bottom of each of said sides and said base.

18. A tape dispenser as described in claim 17 wherein said core is inserted and removed from said housing by sliding the ends of said core along said groove.

19. A tape dispenser as described in claim 17 wherein said tape rolls are alternately fed to said top blade and said bottom blade respectively.

20. A tape dispenser or dispenser as described in claim 17 wherein said tape rolls fed to said bottom blade are threaded around said guiding member with the non-adhesive side bearing on said guiding member, and said tape is substantially perpendicular to said bottom blade.

21. A tape dispenser as described in claim 17 wherein said tape blades are serrated on the top edge.

22. A method of dispensing a plurality of pressure sensitive tapes from a tape core comprising:

providing a tape dispenser having a housing and a hollow base filled with a high density material, with two sides securely fastened to said base, said sides being perpendicular to said base;

providing a first and second member spaced apart and securely fastened to the edge of each of said sides, said support member being perpendicular to each of said sides and extending from the outer edge of one side to the outer edge of the other side, said first support member being on the upper portion of said housing and said second support member being on the lower portion of said housing;

providing a removable blade on the top edge of each support member with each of said blades in a verticle position with the cutting edge on top;

providing a rotating circular guide bar located within said housing opposite the lower support member, whereby the back of said pressure adhesive tape will bear against said circular guide bar;

providing a cylindrical core whose diameter is less than the internal diameter of the tape roll;

providing an instrument and tape holder on the back of said tape dispenser and a drawing instrument holder on the side of said tape dispenser;

sliding said pressure sensitive tapes on said cylindrical core;

providing a groove on the inside portion of said sides, said groove having a width slightly larger than the diameter of said core, said groove being formed in a downward and forward direction starting at the upper-back portion of said sides and terminating approximately midway on the internal portion of said sides;

sliding said core containing said pressure sensitive tapes in said groove until said core reaches the bottom of said groove;

guiding said tapes alternately to the top of said blade on said first support member whereby said tape is cut to a desired length;

guiding the remaining tapes under said guide bar to the top of said second support member whereby said tape is cut to the desired length.

23. A method of dispensing a plurality of pressure sensitive tapes as described in claim 22 wherein the cutting edge of the removable blade on the top edge of each support member is serrated.

* * * * *